US010889978B2

(12) United States Patent
Stevens et al.

(10) Patent No.: US 10,889,978 B2
(45) Date of Patent: Jan. 12, 2021

(54) METHOD OF CONNECTING AND INSTALLING A BUILDING MEMBER

(71) Applicant: Studco Australia Pty Ltd, Croydon South (AU)

(72) Inventors: Ben Stevens, Croydon South (AU); Simon McKechnie, Croydon South (AU)

(73) Assignee: Studco Australia Pty Ltd.

( * ) Notice: Subject to any disclaimer, the term of this patent is extended or adjusted under 35 U.S.C. 154(b) by 0 days.

(21) Appl. No.: 15/919,523

(22) Filed: Mar. 13, 2018

(65) Prior Publication Data

US 2019/0194930 A1 Jun. 27, 2019

(30) Foreign Application Priority Data

Dec. 21, 2017 (AU) ..... 2017905123

(51) Int. Cl.
*E04B 2/82* (2006.01)
*E04B 1/18* (2006.01)
(Continued)

(52) U.S. Cl.
CPC ..... *E04B 1/185* (2013.01); *E04B 1/40* (2013.01); *E06B 1/18* (2013.01); *E04B 2001/405* (2013.01)

(58) Field of Classification Search
CPC ..... E04B 1/185; E04B 1/40; E04B 2001/405
(Continued)

(56) References Cited

U.S. PATENT DOCUMENTS 1,787,167 A * 12/1930 Purdy ..... E04B 1/2604 16/249
3,423,898 A * 1/1969 Coloney ..... E04B 1/2608 403/4

(Continued)

*Primary Examiner* — Basil S Katcheves
(74) *Attorney, Agent, or Firm* — Woods Oviatt Gilman LLP; Katherine H. McGuire, Esq.

(57) ABSTRACT

Bracket apparatus for use in connecting an elongate first building member to at least one second building member, said bracket apparatus including a first member, a second member and a connecting portion joining said first member and said second member, a slot located in either or both said first and second members, wherein, in use, the bracket apparatus is affixed to said at least one second building member and then loosely connected to a first end of the first building member through said slot and thereafter the position of the first building member is adjusted relative to said at least one second building member until a desired position is reached whereupon said bracket apparatus is securely fastened to said first building member. Also disclosed is a method of connecting the elongate first building member to a pair of second building members separated by a distance, the method including the steps of fixing a first bracket to one of said second building members and fixing a second bracket to the other one of said second building members, loosely connecting a first end of said first building member to said first bracket using a slot in said first bracket, positioning and fitting a second end of the first building member to said second bracket using a slot in said second bracket, said slot in said second bracket orientated differently to the slot in said first bracket, adjusting the first building member relative to said pair of second building members to a desired position, and securing the first building member to each of said first and second brackets.

9 Claims, 5 Drawing Sheets

(51) Int. Cl.
*E04B 1/41* (2006.01)
*E06B 1/18* (2006.01)
*E04B 1/38* (2006.01)

(58) Field of Classification Search
USPC ..... 52/126.1, 127.2, 285.3, 712, 656.1, 645
See application file for complete search history.

(56) References Cited

U.S. PATENT DOCUMENTS 3,596,941 A * 8/1971 Tracy ..... E04B 1/2608 403/190
4,531,334 A * 7/1985 Nylander ..... E04B 1/98 248/228.4
4,893,961 A * 1/1990 O'Sullivan ..... E04B 1/2608 403/187
5,058,358 A * 10/1991 Stratton ..... E04B 1/2612 248/214
5,547,169 A * 8/1996 Russell ..... E04H 17/1443 256/59
6,029,954 A * 2/2000 Murdaca ..... E04F 11/1834 256/59
6,398,193 B1 * 6/2002 DeSouza ..... E04H 17/1421 256/19
D468,792 S * 1/2003 Jacoway ..... D21/801
6,792,733 B2 9/2004 Wheeler et al.
6,799,408 B2 * 10/2004 Brady ..... E04B 2/7457 52/210
6,857,240 B1 * 2/2005 MacAlister ..... E04B 2/16 52/442
6,941,716 B2 9/2005 Kottman
6,948,704 B2 * 9/2005 Forbis ..... E04F 11/1817 256/65.08
7,104,024 B1 * 9/2006 diGirolamo ..... E04B 2/767 403/231
D601,882 S 10/2009 Mirer et al.
7,654,783 B2 2/2010 Giraud
7,712,266 B2 * 5/2010 Sarkisian ..... E04H 9/02 52/167.1
D619,879 S * 7/2010 McCarthy ..... D8/354
7,918,054 B2 * 4/2011 Grafton ..... E04B 7/02 248/291.1
8,210,504 B1 * 7/2012 Skornickel ..... E04H 17/1421 256/65.01
8,250,822 B2 8/2012 O'Connor
D667,718 S * 9/2012 Preda ..... D8/354
8,484,927 B2 * 7/2013 Nguyen ..... E04B 7/063 52/714
8,540,201 B2 * 9/2013 Gadd ..... E04B 1/2612 248/300
8,615,942 B2 * 12/2013 Lafreniere ..... E04B 2/766 52/204.2
8,651,443 B2 2/2014 Mayer
9,139,999 B2 * 9/2015 Nicholls ..... E04B 1/2612
9,291,179 B2 3/2016 Pierce et al.
9,322,180 B2 * 4/2016 Burt ..... E04F 11/1834
D848,621 S * 5/2019 McGee ..... D24/183
2005/0005561 A1 * 1/2005 Hanson ..... E04B 1/24 52/633
2006/0096192 A1 * 5/2006 Daudet ..... E04B 1/24 52/204.1
2006/0096201 A1 * 5/2006 Daudet ..... E04B 1/24 52/272
2006/0277841 A1 12/2006 Majusiak
2007/0292204 A1 * 12/2007 Hackney ..... E04B 1/10 403/93
2008/0168733 A1 7/2008 Tollenaar
2008/0196337 A1 8/2008 Surowiecki
2008/0237421 A1 * 10/2008 Szpotowski ..... E04B 1/2612 248/222.51
2009/0151282 A1 * 6/2009 Loayza ..... E04B 1/161 52/261
2010/0050561 A1 * 3/2010 Jafari ..... H02G 3/126 52/712
2017/0175381 A1 * 6/2017 Wesney ..... E04B 1/40
2018/0066425 A1 * 3/2018 Ralph ..... E04B 1/2403
2018/0094426 A1 * 4/2018 Winter ..... E04B 1/003

* cited by examiner 10A
3 X STUD
92 X 35
42

10A
2 X STUD
150 X 35
40

10A
2 X HEDAJAMB
92 X 89
48

10A
2 X HEDAJAMB
92 X 63.5
44

10A
1 X HEDAJAMB
92 X 89
50

10A
1 X HEDAJAMB
92 X 63.5
52

10A
46
2 X STUD
92 X 35

10A
54
1 X STUD
92 X 35

METHOD OF CONNECTING AND INSTALLING A BUILDING MEMBER

FIELD OF THE INVENTION

This invention relates to a method of connecting a first building member to a pair of second building members where each of the second building members are spaced apart, and more particularly to a method of installing a header or beam between a pair of spaced-apart studs. The invention also relates to a bracket apparatus for use in connecting an elongate first building member to at least one second building member. Once installed or connected, the bracket apparatus does not protrude below a lower surface of the header or beam, thereby leaving a space clear of obstructions in which to install a building assembly, such as a window assembly.

BACKGROUND OF THE INVENTION

In order to install at right angles a beam or a header building component between a pair of other building components, such as a pair of studs, it always requires at least two people and it is necessary to keep the header parallel to the ground or at least perpendicular to the studs. This is due to the fact that the header has to be firstly connected to one of the studs and, due to its usually long length, it is not possible for one person to hold the header and connect it to the other stud while maintaining a perpendicular relationship between the studs and the header.

Furthermore, prior installations of a frame assembly into which building components, such as a window assembly, are fitted provide obstructions, for example bracket protrusions, bolts, nuts and screw heads that interfere with such a fitting by protruding into the space inside the frame assembly. This then requires the window assembly or other building component to be packed, or have packing around it, which is time consuming and a waste of time and human resources.

There is a need to provide a method of installing and fitting a building member to at least one other building member using only one person which would save the time of a second person that is used, and save costs in which previously each installation has required at least two people to perform. There is also a need to provide apparatus to effect the installation such that there is no obstruction or intrusion on an open space inside a framework used to insert a building component.

SUMMARY OF THE INVENTION

According to a first aspect of the invention, there is provided a method of connecting an elongate first building member to a pair of second building members separated by a distance, the method including the steps of:

fixing a first bracket to one of said second building members and fixing a second bracket to the other one of said second building members;

loosely connecting a first end of said first building member to said first bracket using a slot in said first bracket;

positioning and fitting a second end of the first building member to said second bracket using a slot in said second bracket, said slot in said second bracket orientated differently to the slot in said first bracket;

adjusting the first building member relative to said pair of second building members to a desired position; and securing the first building member to each of said first and second brackets.

The method steps may be carried out by a single user. The adjusting step preferably involves positioning said first member orthogonal to one or both of said second building members. The first bracket slot is preferably dimensioned to enable movement of a fastener within the first bracket slot. The second bracket slot can be dimensioned to enable movement of a fastener within the second bracket slot. Each of the first bracket slot and the second bracket slot are preferably elongate and positioned orthogonally to one another. Each of the first and second brackets may have more than one slot with at least two of those slots orthogonal to one another.

The method may further include allowing movement of the first building member through the loose connection to the slot of the first bracket, said first slot bracket being horizontally arranged, to enable connection of the first building member to the second bracket. The slot of the second bracket is preferably vertically arranged to enable levelling of the first building member such that the first building member is moveable up and down before being firmly secured to the other of said second building members.

According to a second aspect of the invention, there is provided bracket apparatus for use in connecting an elongate first building member to at least one second building member, said bracket apparatus including:

a first member, a second member and a connecting portion joining said first member and said second member;

a slot located in either or both said first and second members;

wherein, in use, the bracket apparatus is affixed to said at least one second building member and then loosely connected to a first end of the first building member through said slot and thereafter the position of the first building member is adjusted relative to said at least one second building member until a desired position is reached whereupon said bracket apparatus is securely fastened to said first building member.

According to an embodiment of the invention, the bracket apparatus is a pair of brackets for use in connecting an elongate first building member to a pair of second building members separated by a distance, each bracket in said pair of said brackets including:

a first member and a second member and a connecting portion joining said first and second members;

the first bracket having a slot located in the first member or the second member or both members of the first bracket;

the second bracket having a slot located in the first member or the second member or both members of said second bracket and orientated differently to the slot in said first bracket;

wherein, in use, said first bracket is affixed to one of said second building members and said second bracket is affixed to the other one of said second building members, a first end of said first building member is loosely connected to said first bracket using the slot in said first bracket; a second end of the first building member is fitted to said second bracket using said slot in said second bracket;

wherein further the first building member is adjusted relative to said pair of second building members to a desired position and each bracket is then securely fastened to fasten a respective bracket to the first building member.

A single user preferably connects the first building member to the pair of second building members. Preferably the orientation of the bracket apparatus with the first building member enables a surface of the first building member to remain substantially smooth and free of protrusions such that a clear open space is created by a frame formed by the first building member, said at least one second building member and a floor into which a building component is fitted free of said protrusions or obstructions.

Positioning of said first building member is preferably made orthogonal to one or both of said second building members. Preferably the slot of the second bracket is vertically arranged to enable levelling of the first building member such that the first building member is moveable up and down before being firmly secured to the other of said second building members.

BRIEF DESCRIPTION OF THE DRAWINGS

A preferred embodiment of the invention will hereinafter be described by way of example only, with reference to the drawings in which.

DETAILED DESCRIPTION OF THE EMBODIMENT

Figure 1:
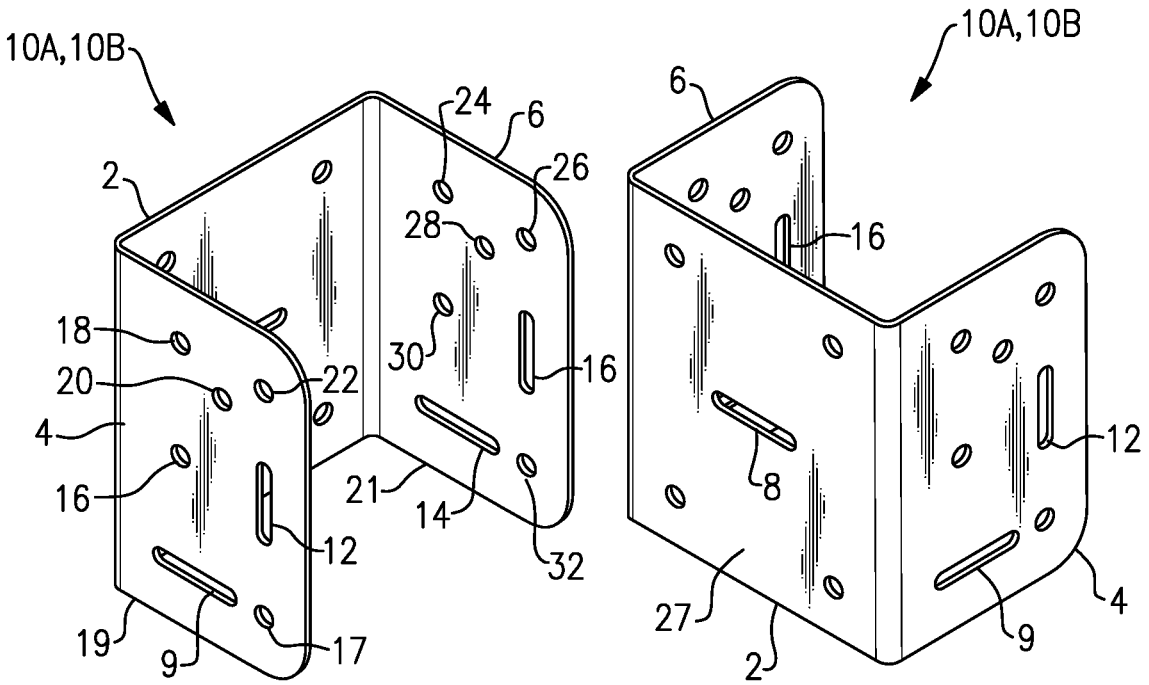
FIG. 1 is a perspective view from above of a bracket having a series of apertures that enable adjustment of a first building member with respect to a pair of second building members.
Figures 2A, 2B, 2C, 2D, 2E, 2F, 2G, 2H:
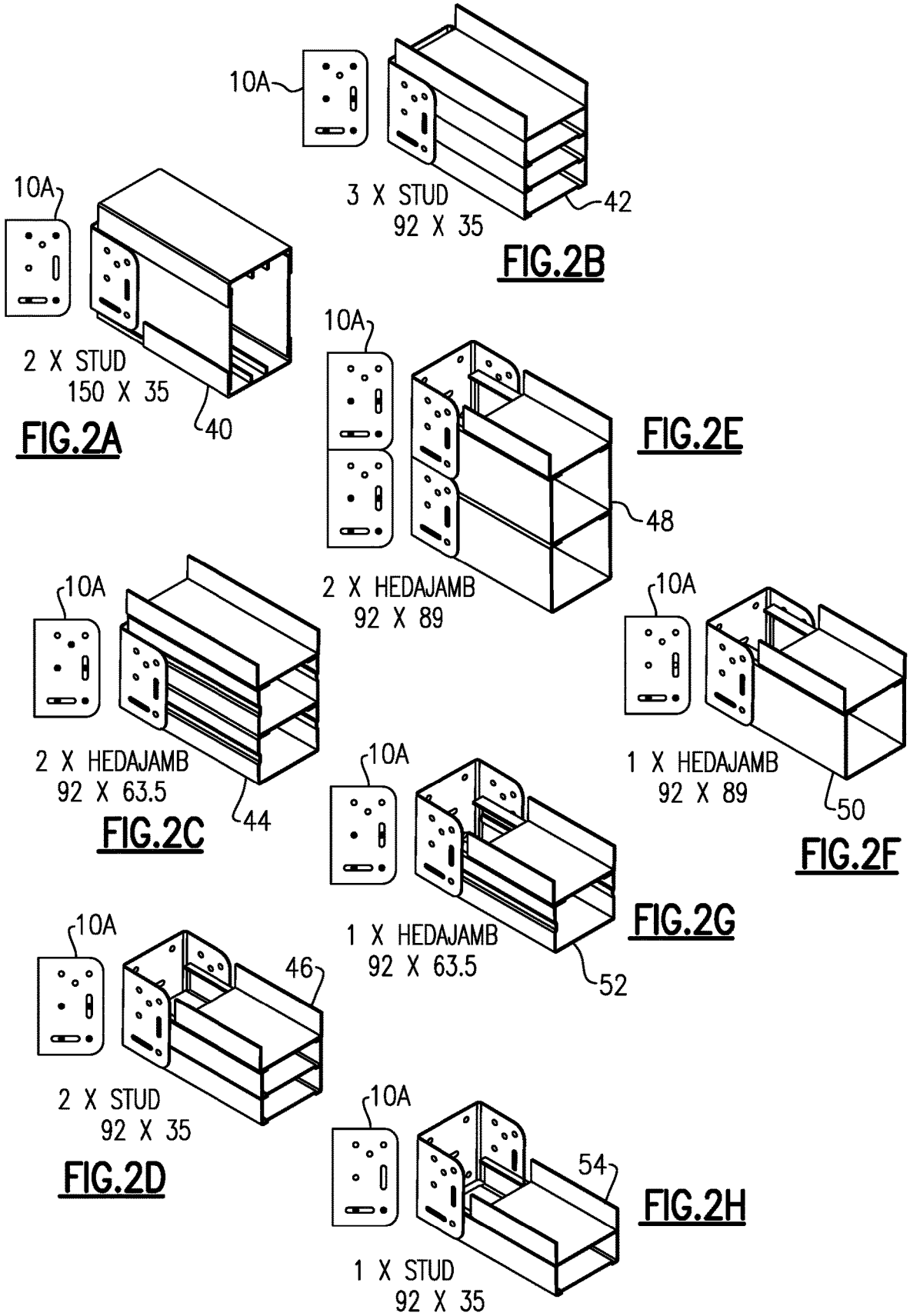
FIGS. 2A-2H are perspective views from above showing at least one of the brackets in FIG. 1 connected to the first building member where the first building member can be in various forms.

Referring to FIG. 1 there is shown a bracket 10 having a joining or connecting portion 2 that can be termed a web, and first and second members 4 and 6 which are formed at right angles to the portion 2. The first and second members 4 and 6 can be regarded as depending portions, flanges or legs. The first member 4 has a horizontally oriented aperture in the form of slot 9 that is generally elongate and a vertically oriented aperture, in the form of an elongate slot 12. Each of the slots 9 and 12 enable final adjustment of a connection of a first building member to a pair of second building members where the head of a fastener, such as a screw may be able to move within each slot 9 and 12 before finally being tightened in position when the final adjustment is made. The second member 6 similarly has an aperture 14, which is arranged horizontally similar to elongate slot 9. It also has a vertically oriented aperture 16, in the form of an elongate slot similar to slot 12. A number of apertures 16, 18, 20 and 22 are provided on member 4 to enable fasteners to fasten portion 4 to the same first building member. Similarly member 6 has apertures 24, 26, 28 and 30 to enable fasteners to fasten member 6 to the first building member.

On connecting portion 2 there is an elongate aperture in the form of slot 8 which enables connection of the bracket 10 to one of the pair of second building members, such as a stud as will hereinafter be described.

Shown in FIGS. 2A to 2H are various perspective views of one bracket 10 connected to a range of building members that can be headers, beams or tracks. Some embodiments show the use of two stacked brackets 10, such as in FIG. 2E, that are used one above the other in order to enable connection of the building member 48 to a further member such as a stud.

Figure 3:
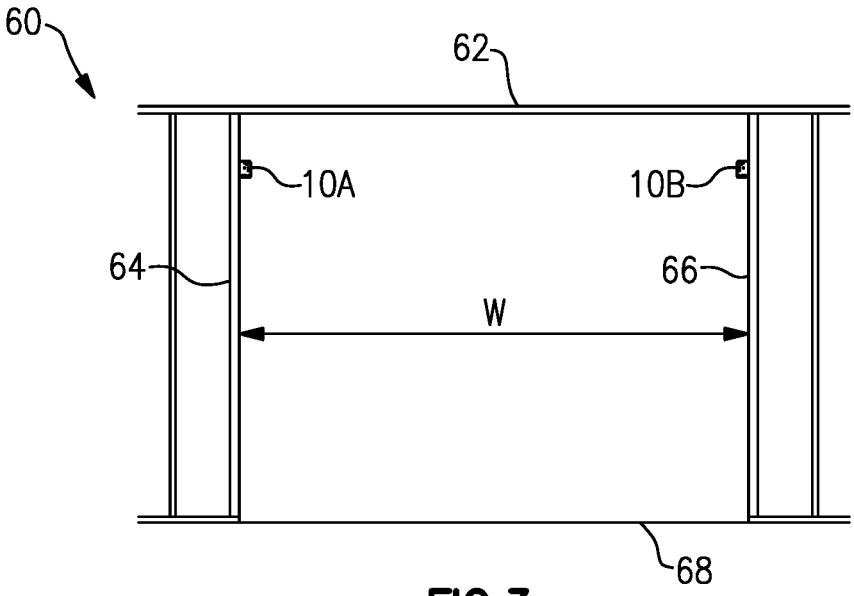
FIG. 3 is a side view showing a pair of second building members, in the form of vertically orientated studs, positioned to have a first building member connected between them.

Referring to FIG. 3 there is shown a building arrangement 60 which requires a first building member 72 to be positioned between two brackets 10A and 10B respectively connected to one of the pair of second building members 64 and 66. The pair of second building members, being a first stud 64 and a second stud 66 is separated by a distance W. Each stud 64 and 66 extends between a beam or ceiling 62 and a floor 68. A bracket 10A is affixed, through a fastener in slot 8, to each stud 64 and 66 in a position where it is desired to install a first building member in the form of a header or beam, at the required height. The user is required to cut the header by about 20 min so that its overall length is (W-20 mm).

Figure 4:
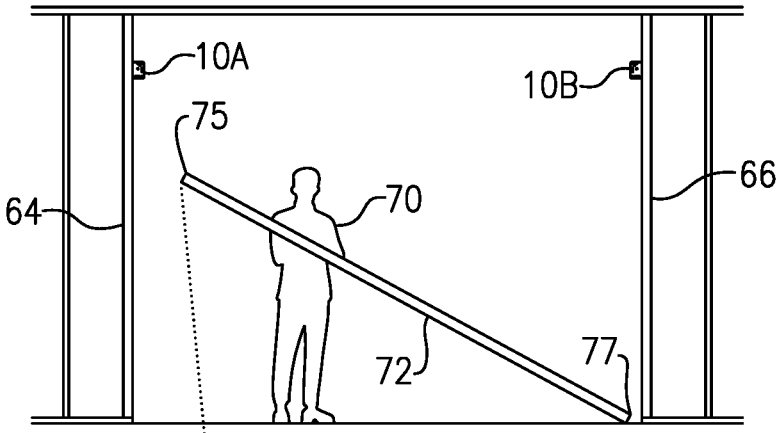
FIG. 4 is a side view showing a person about to attach one end of the first building member to one of the second building members.
Figure 4A:
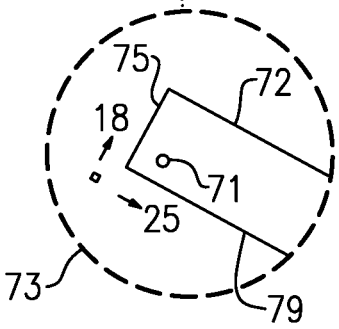
FIG. 4A is an enlarged view of a first end of the first building member showing an aperture located near the first end.

Referring to FIG. 4 a user 70 holds a header 72 ready to be connected to stud 64 through bracket 10A. FIG. 4A shows an aperture 71, pre-drilled at end 75 in both flanges (or sides) of the header 72 with a 3 mm drill, through which a fastener can connect the end 75 to the bracket 10A through both flanges. The aperture is positioned about 25 mm from the end 75 and about 18 mm above a bottom edge 79 of the flanges of the header 72.

Figure 5:
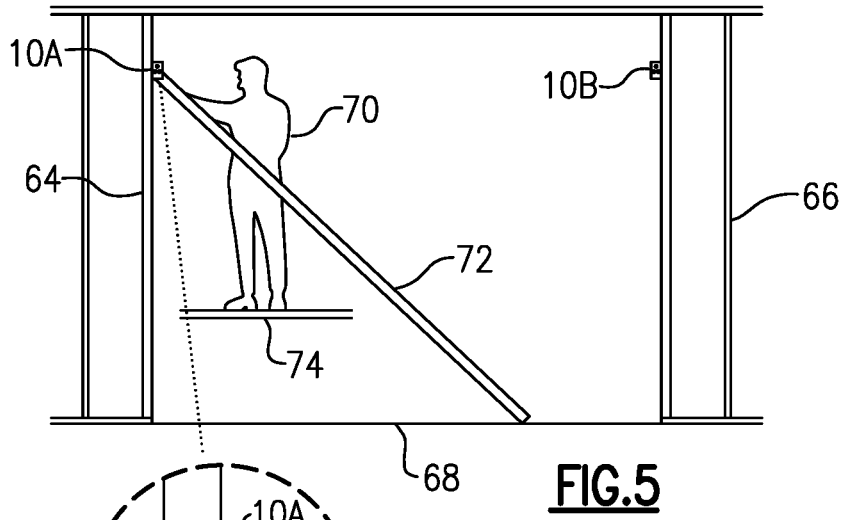
FIG. 5 is a side view showing the user elevated on a platform about to connect the first end of the first building member to one of the pair of second building members.
Figure 5A:
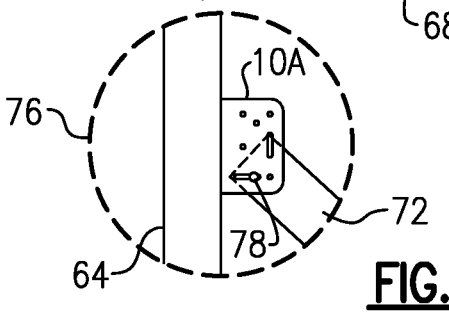
FIG. 5A is an enlarged view of the connection of the first building member to the first of the second building members.

In FIG. 5 the user 70 is positioned on a platform 74 above the floor 68 in order to fit the end 75 to the bracket 10A on stud 64. A fastener 78, such as a self-drilling screw, is inserted through the aperture 71 in each flange of the header 72 and also through slot 9 of the bracket 10A that are loosely affixed so that the header 72 can still move relative to the first bracket 10A. FIG. 5A shows in detail the fastener 78 which positioned in slot 9 of one of the sides/flanges of header 72.

Figure 6:
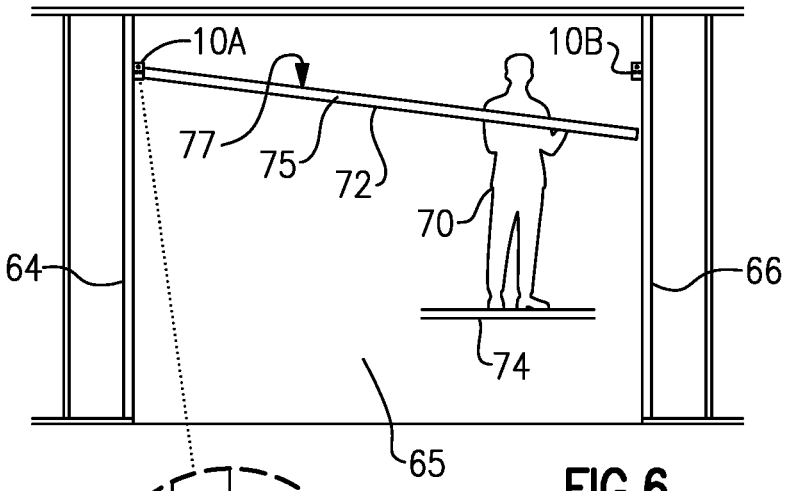
FIG. 6 is a side view showing the connection of the first building member at the first end and the user ready to connect the second end of the first building member to the other second building member.

Referring to FIG. 6, the user has moved to a position near to stud 66 and while supported by platform 74 lifts the header 72 upwards so that the connection at the first bracket 10A to stud 64 allows the header 74 to be able to slide horizontally. As the header 72 has its second end 77 put in position near corresponding second bracket 10B, affixed to stud 66 (in the same manner as first bracket 10A was affixed to stud 64), the header 72 is able to slide with respect to the first bracket 10A.

Figure 6A:
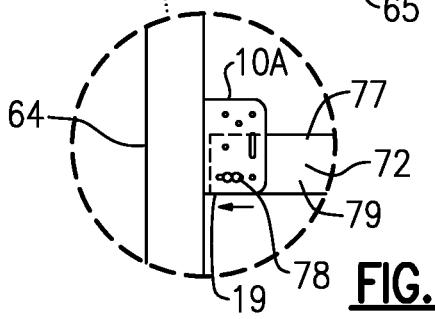
FIG. 6A is an enlarged view showing the connection of the first building member to the first of the second building members through a first bracket.

FIG. 6A shows that the header 72 is now perpendicular to the stud 64 but the fastener 78 is still loose within the slot 9. This figure (as well as FIGS. 2A to 2H and FIG. 7A in relation to bracket 10B) also shows that the edge 19 of member 4 of bracket 10A (and equally edge 21 of member 6 of bracket 10A) sits flush with or in line with the bottom surface 73 of header 72. Thus the orientation of the bracket 10A (and 10B) is such that the inside surface of connecting portion 2 contacts end 75 of header 72, the inside surface of member or flange 4 contacts a front side surface 79 of header 72 so that lower edge 19 is substantially level with bottom surface 73, and the inside surface of member or flange 6 contacts a rear side surface 77 of header 72 so that lower edge 21 of member 6 is also substantially level with bottom surface 73 as seen in FIG. 6A. A similar orientation applies to bracket 10B as seen in FIG. 7A. It is Tis orientation of the bracket 10A, 10B in relation to the header 72 that provides a clear opening or space 65 bounded by the studs 64, 66 floor 68 and beam 72 (see FIGS. 7 and 8) into which a building component, such as a prefabricated window assembly, can easily fit without any obstructions or projections such as screws, bolt ends, nuts or bolt heads, getting in the way of such a fitting. It can be positioned easily and quickly and then secured to the frame around the open space 65. The flushness of the bottom edges of bracket 10A with bottom surface 73 of header 72, such that they are in line with one another, enables any building assembly inserted beneath or attached to the bottom surface of the header 72 to be presented with a smooth or flush surface finish without protrusions interfering with the fitting.

Figure 7:
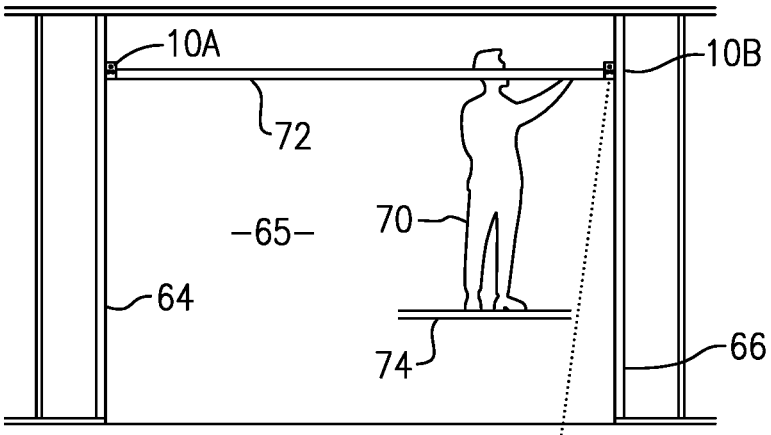
FIG. 7 is a side view showing the user connecting the first building member through a second bracket to the second of the second building members.
Figure 7A:
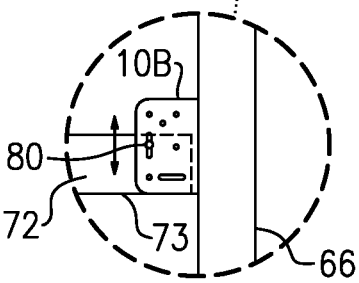
FIG. 7A is an enlarged view of the connection of the second end of the first building member to the second of the second building members.

Referring to FIG. 7 the user 70 has affixed the second bracket 10B to the stud 66 by using a fastener which protrudes through a corresponding aperture at or near end 77 through each flange of the header 72 and also protrudes through the vertical slot 16 on the bracket portion 6 of second bracket 10B. The fastener is initially made or connected loosely so that there is vertical movement up and down the slot 16, The user 70 can make the header level, using a level device and when it is measured to be level then the fastener 80 is tightened to secure the header 72 to the stud 66. Any number of the apertures, for example 24 to 32 can be used to make a definitive connection between the sides or flanges of the header 72 and the stud 66 through the second bracket 10B.

FIG. 7A shows in detail the position of the fastener 80 in the slot 16.

Figure 8:
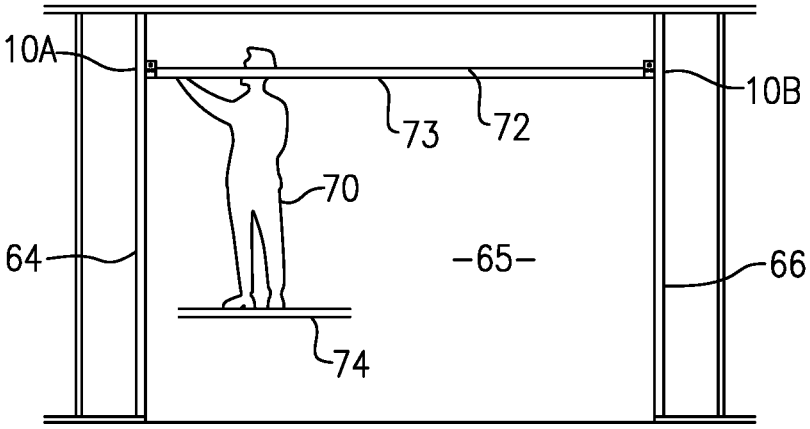
FIG. 8 is a side view showing the user tightening fasteners at the two brackets that respectively connect the first building member to each of the second building members.

With regard to FIG. 8 the user 70 moves to the first connection end (that is between the first bracket 10A and stud 64 to tighten up the fastener 78, now that the header 72 is level. Other screws are used to affix the two components together, for example up to three screws per flange or six screws per end using the apertures 16 to 22 and 24 to 32 in the respective members 4 and 6 of that bracket 10A or 10B.

The building arrangement 60 now comprises a header 72 positioned between upright studs 64 and 66 connected by a pair of brackets 10A or 10B.

The invention claimed is:

1. A method of connecting an elongate first building member to a pair of second building members separated by a distance, the method including the steps of:

providing first and second brackets, wherein each of said first and second brackets includes: a) a respective back plate having opposing first and second side edges, wherein each said respective back plate is configured to fix a respective bracket to a respective second building member, and b) a respective side plate coterminous with a respective first side edge of said first and second brackets and extending orthogonally to said respective back plate, wherein said each said respective side plate includes a first elongated slot oriented perpendicularly to a second elongated slot;

fixing said first bracket to one of said second building members via said back plate of said first bracket and fixing said second bracket to the other one of said second building members via said back plate of said second bracket;

loosely connecting a first end of said first building member to said first bracket using said first elongated slot in said first bracket;

positioning and fitting a second end of the first building member to said second bracket using said second elongated slot in said second bracket;

adjusting the first building member relative to said pair of second building members to a desired position; and securing the first building member to each of said first and second brackets.

2. The method according to claim 1 wherein the method steps are carried out by one user.

3. The method according to claim 1 wherein said adjusting step involves positioning said first member orthogonal to one or both of said second building members.

4. The method according to claim 1 wherein the first bracket slot is dimensioned to enable movement of a fastener within the first bracket slot.

5. The method according to claim 1 wherein the second bracket slot is dimensioned to enable movement of a fastener within the second bracket slot.

6. The method according to claim 5 wherein each of the first bracket slot and the second bracket slot are elongate and positioned orthogonally to one another.

7. The method according to claim 1 wherein each of the first and second brackets has more than one slot with at least two of those slots orthogonal to one another.

8. The method according to claim 1 including allowing movement of the first building member through the loose connection to the slot of the first bracket, said first slot bracket being horizontally translated to enable connection of the first building member to the second bracket.

9. The method according to claim 8 wherein the slot of the second bracket is vertically arranged to enable levelling of the first building member such that the first building member is translatable up and down before being firmly secured to the other of said second building members.

* * * * *